US012434131B2

(12) United States Patent
Curatti et al.

(10) Patent No.: US 12,434,131 B2
(45) Date of Patent: Oct. 7, 2025

(54) GAMING HARDWARE DEVICE, A BOARD GAME KIT AND RELATED CONTROL METHOD

(71) Applicant: SPRAMA GAME LABS S.R.L., Cagliari (IT)

(72) Inventors: Stefano Curatti, Settimo San Pietro (IT); Daniele Muntoni, Sarroch (IT)

(73) Assignee: SPRAMA GAME LABS S.R.L., Cagliari (IT)

( * ) Notice: Subject to any disclaimer, the term of this patent is extended or adjusted under 35 U.S.C. 154(b) by 104 days.

(21) Appl. No.: 18/578,193

(22) PCT Filed: Jul. 5, 2022

(86) PCT No.: PCT/IB2022/056192
§ 371 (c)(1),
(2) Date: Jan. 10, 2024

(87) PCT Pub. No.: WO2023/012545
PCT Pub. Date: Feb. 9, 2023

(65) Prior Publication Data

US 2024/0374986 A1 Nov. 14, 2024

(30) Foreign Application Priority Data

Aug. 2, 2021 (IT) ..... 102021000020747

(51) Int. Cl.
*A63F 3/00* (2006.01)

(52) U.S. Cl.
CPC ..... *A63F 3/00643* (2013.01); *A63F 3/0023* (2013.01); *A63F 2003/00258* (2013.01); *A63F 2003/00662* (2013.01)

(58) Field of Classification Search
None
See application file for complete search history.

(56) References Cited

U.S. PATENT DOCUMENTS 8,602,857 B2 * 12/2013 Morichau-Beauchant ..... A63F 3/00643 463/9
9,716,533 B2 * 7/2017 Shimomura ..... H04B 5/77
(Continued)

FOREIGN PATENT DOCUMENTS

| | | | |
|---|---|---|---|
| FR | 3004267 | A1 | 10/2014 |
| GB | 2344257 | A | 5/2000 |
| WO | 2012033863 | A1 | 3/2012 |

OTHER PUBLICATIONS

International Search Report and Written Opinion for Corresponding International Application No. PCT/IB2022/056192, 8 pages, Oct. 20, 2022.

*Primary Examiner* — Seng H Lim
(74) *Attorney, Agent, or Firm* — Lucas & Mercanti, LLP

(57) ABSTRACT

A gaming hardware device is disclosed having an interactive gaming platform that can be connected to a multi-purpose central console. The electronics for making an interactive board game are divided so that a minimal part is in an interactive platform that includes the game board, while all the logic and processing part is relegated to a central console that can be reused also for other interactive platforms. A game kit having the hardware device and a plurality of game pieces containing a passive RFID TAG readable by the central console as well as a method of controlling a board game kit are also disclosed.

9 Claims, 7 Drawing Sheets

(56) References Cited

U.S. PATENT DOCUMENTS

| | | | | |
|---|---|---|---|---|
| 10,821,350 | B1 * | 11/2020 | Schukar | G06F 3/0346 |
| 10,857,450 | B1 * | 12/2020 | Aman | A63F 13/213 |
| 11,110,341 | B2 * | 9/2021 | Knippen | G09B 19/22 |
| 11,224,796 | B1 * | 1/2022 | Aman | G06F 3/013 |
| 12,157,064 | B1 * | 12/2024 | Aman | A63F 3/00214 |
| 2008/0284723 | A1 * | 11/2008 | Cohen | G06F 3/03 341/20 |
| 2010/0201069 | A1 * | 8/2010 | Lam | G01S 13/876 273/237 |
| 2010/0331083 | A1 * | 12/2010 | Maharbiz | A63F 3/00003 273/237 |
| 2015/0339021 | A1 * | 11/2015 | Duteil | G06F 3/0487 345/156 |
| 2016/0310832 | A1 * | 10/2016 | Dandamudi | A63F 13/235 |
| 2016/0334906 | A1 * | 11/2016 | Shi | A63F 13/95 |
| 2018/0071615 | A1 * | 3/2018 | Maharbiz | A63F 3/00643 |
| 2019/0022517 | A1 * | 1/2019 | Socorregut | A63F 3/00643 |
| 2020/0222793 | A1 * | 7/2020 | Garofalo | A63F 13/214 |
| 2022/0032167 | A1 * | 2/2022 | McCoy | B25J 11/003 |
| 2022/0258036 | A1 * | 8/2022 | Garofalo | A63F 3/00643 |
| 2022/0266129 | A1 * | 8/2022 | Lee | A63F 13/24 |
| 2023/0364497 | A1 * | 11/2023 | Thomson | A63F 9/34 |
| 2024/0252910 | A1 * | 8/2024 | Garofalo | A63F 3/00643 |

* cited by examiner

GAMING HARDWARE DEVICE, A BOARD GAME KIT AND RELATED CONTROL METHOD

CROSS-REFERENCE TO RELATED APPLICATIONS

This application is a 371 of PCT/IB2022/056192, filed Jul. 5, 2022, which claims the benefit of Italian Patent Application No. 102021000020747, filed Aug. 2, 2021.

FIELD OF THE INVENTION

The present disclosure generally relates to interactive board games and more particularly to a board game hardware device comprising a central console interchangeably connectable with an interactive board game platform.

BACKGROUND OF THE INVENTION

Interactive board games are increasingly popular today, in which electronic devices and computer programs run by microprocessor units interact with classic elements of board games, such as a board and pawns, to generate new effects that enhance the gaming experience. Such games involve the use of a game board, or a game table, which includes a plurality of antennas or RFID readers configured to identify RFID TAGs embedded in pawns or pieces to be placed on the game board or table while playing the game.

An example of interactive games of this type is described in WO2012033863, which discloses a board game made with a game board, game pieces or pawns, at least one memory device and a controller. Each of the game pieces comprises a unique identifier to which information, stored in the memory device, is associated which defines characteristics or attributes of the corresponding game piece when used. During the game, multimedia events are generated depending on the type and movement of the pieces on the board or game table. To identify the position and type of each pawn or game piece, RFID readers are present in the game board or game table and the game table has a dedicated electronic device for this purpose, configured to interact with a computer in which a card containing the game software can be inserted.

Such an electronic device must be carefully designed to be able to read in a selective manner each single RFID reader inserted in the game table, avoiding problems of interference with other readers. Furthermore, such a board game would be expensive because it would be necessary to realize a dedicated electronic device for each game table.

SUMMARY OF THE INVENTION

One objective of this disclosure is to overcome at least partially the limitations of the prior art solutions. This objective is achieved with a gaming hardware device as defined in the annexed claim 1, in which the electronics for making an interactive board game are divided so that a minimal part is in an interactive platform which includes the game board, while all the logic and processing part is installed in a central console that can also be used for other interactive platforms.

A further object of this disclosure is a game kit comprising a hardware device of this disclosure and a plurality of game pieces containing a passive RFID TAG readable by the central console.

A method of controlling a board game kit is also disclosed.

Preferred embodiments are defined in the attached claims.

DETAILED DESCRIPTION OF THE INVENTION

Figure 1:
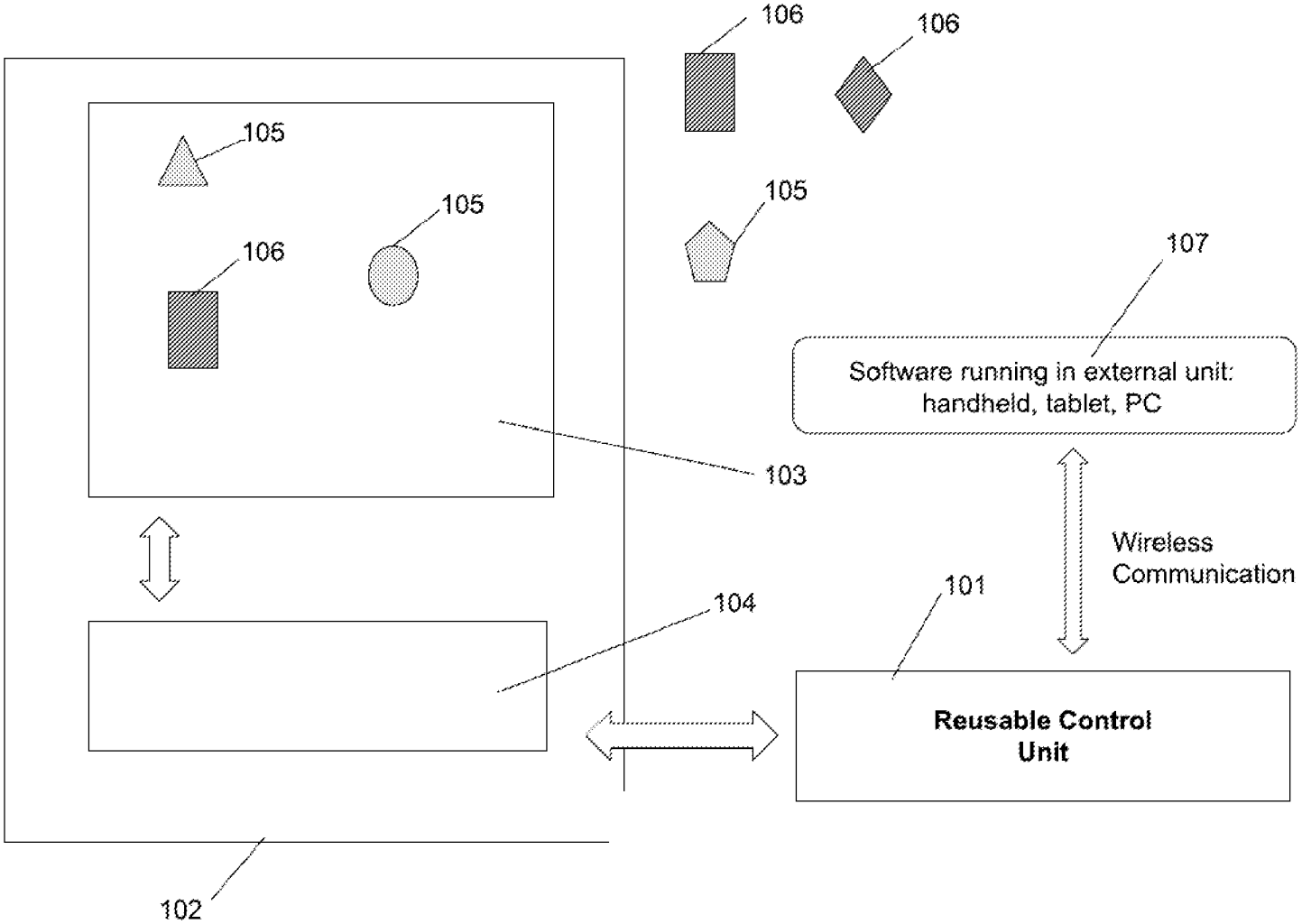
FIG. 1 shows an exemplary embodiment of a board game kit according to an aspect of the present disclosure.
Figure 2:
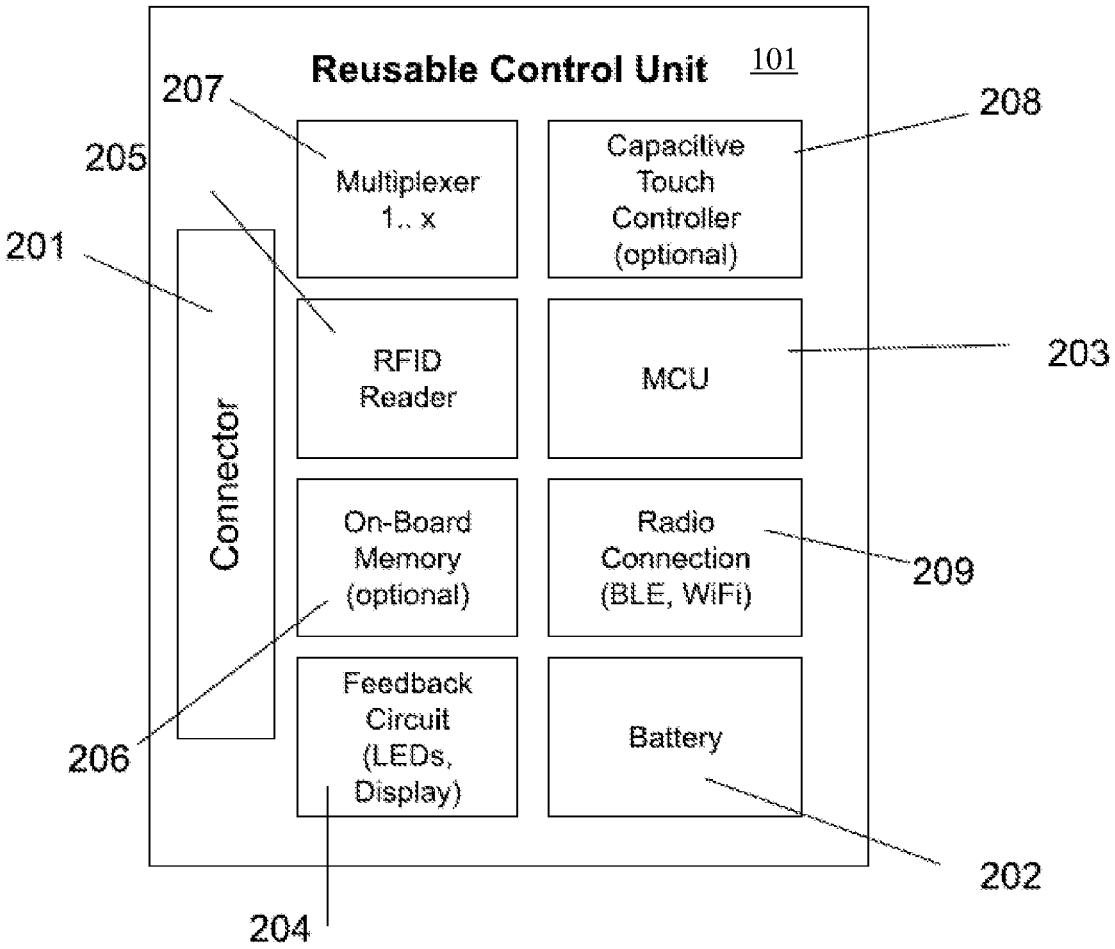
FIG. 2 illustrates an exemplary embodiment of a central console shown in FIG. 1 according to an aspect of the present disclosure.

A schematic diagram of a board game kit according to an aspect of the present disclosure is illustrated in FIG. 1. It comprises a gaming hardware device comprising a central console 101 and a detachable interactive platform 102 connectable to the central console. As will be explained in detail below, the central console 101 and the interactive platforms 102 are configured so that the same central console 101 may be connected to any interactive platform 102 of this disclosure, so as to be able to change the game by reusing the same central console 101.

Figure 3:
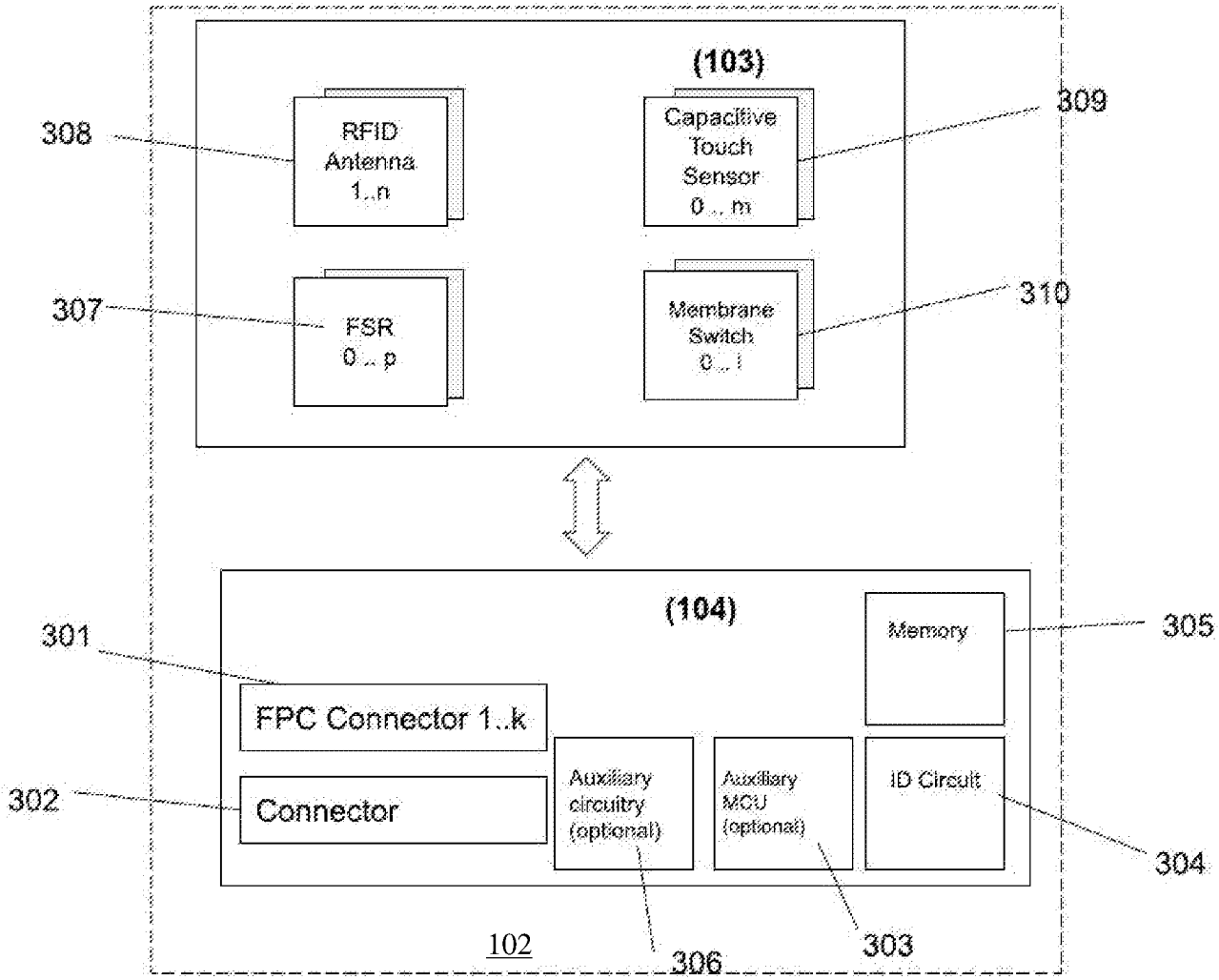
FIG. 3 illustrates an exemplary embodiment of an interactive platform shown in FIG. 1 according to an aspect of the present disclosure.
Figure 4:
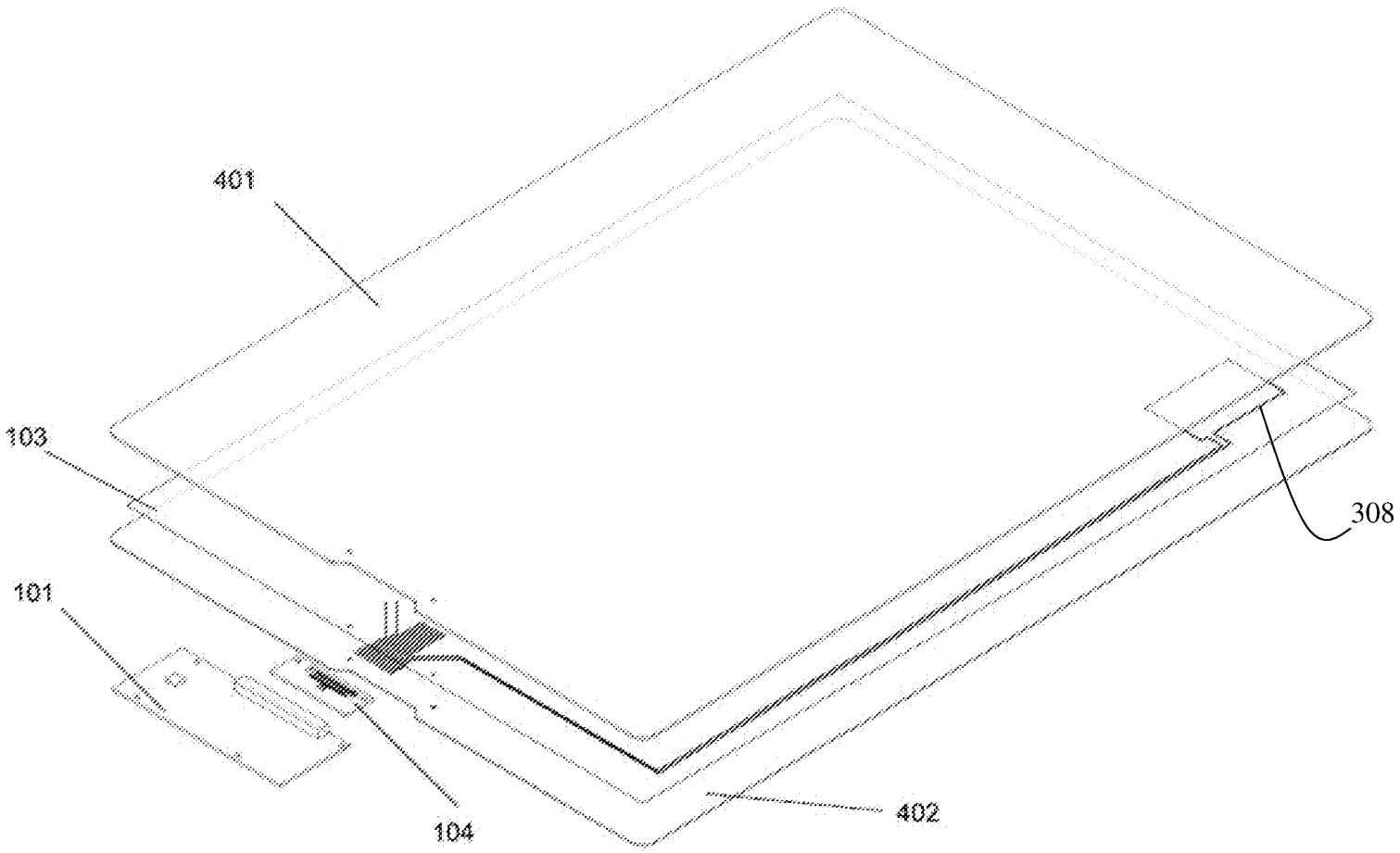
FIG. 4 illustrates an exemplary three-layer structure of an interactive platform game board according to an aspect of the present disclosure.
Figure 5:
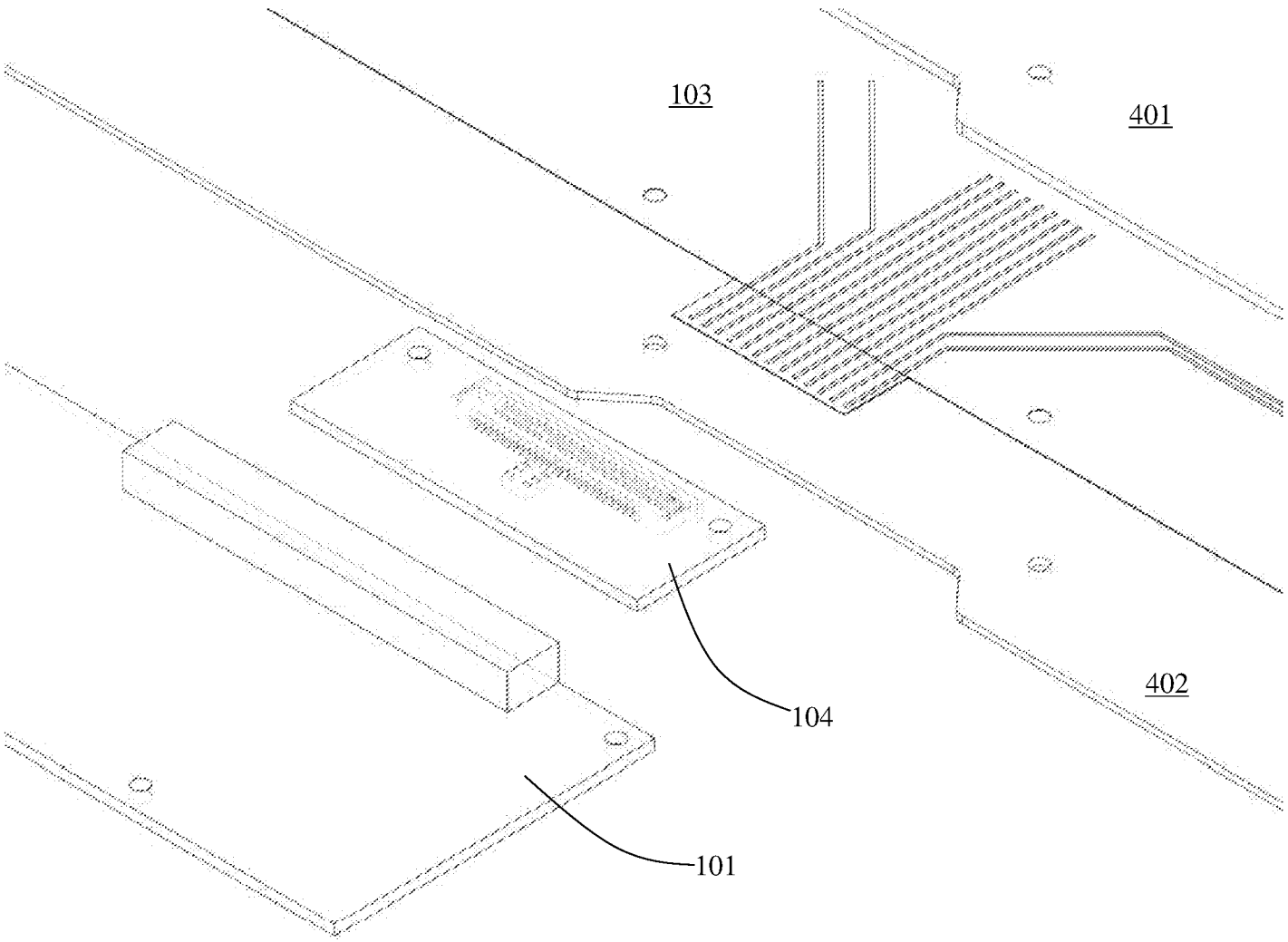
FIG. 5 is a detail view of a portion of the game board of FIG. 4.

The interactive platform 102 of this disclosure comprises a game board and an interface 104 functionally connected to the game board. The game board, illustrated in FIGS. 3, 4 and 5, comprises: a flat flexible bottom support 402, a layer containing a plurality of sensors 103 arranged above the flat flexible bottom support 402, in which each sensor is individually accessible through a respective electrical line which leads to a respective electrical terminal of an array of electrical terminals of the game board; a flat game board 401, for example made of paper or cardboard, or made of flexible material, arranged above the layer with the sensors 103 and configured so as to cover and sandwich the sensors 103 together with the flat bottom support 402, leaving the array of electrical terminals on the game board uncovered. Among the various sensors 103 of the game board, there is at least one antenna 308 configured to read an RFID TAG placed on the game board 401 above the antenna 308, generating a corresponding response signal made available on a respective electrical terminal of the array of electrical terminals of the game board.

Optionally, among the various sensors 103 there may be pressure sensors 307, capacitive touch sensors 309 or even membrane switches 310, to detect the presence of pawns on the game board 401 or to detect actions performed by the players on the game board, such as pressing a button or adjusting a parameter on a level bar.

According to one aspect, between the sensors 103 there is a plurality of antennas 308 arranged above the flat bottom support 402, in which each antenna 308 is configured to be individually activated by means of a respective electrical terminal of the array of electrical terminals of the display game board and to read the RFID TAGs placed on the game board 401 above the antennas 308 generating a corresponding response signal made available on the respective electrical terminal of the array of electrical terminals of the game board.

An advantage of the hardware device of the present disclosure consists in the fact that the antennas 308 are positioned according to the boxes provided in the graphics of the game, in a number sufficient to cover the active positions required by the game. With respect to what is described in the aforementioned prior document WO2012033863, in the game board according to the present disclosure it is possible to follow the game graphics instead of binding it to a matrix of rows and columns, so that the creativity of the game designers is not limited.

According to one aspect, the layer with the sensors 103 is made by means of a flexible Printed Circuit Board and the flat bottom support 402 is made entirely of flexible material and with a thickness determined so that it can be rolled up with bare hands together with the layer with the sensors 103 and the game board 401.

Figure 6:
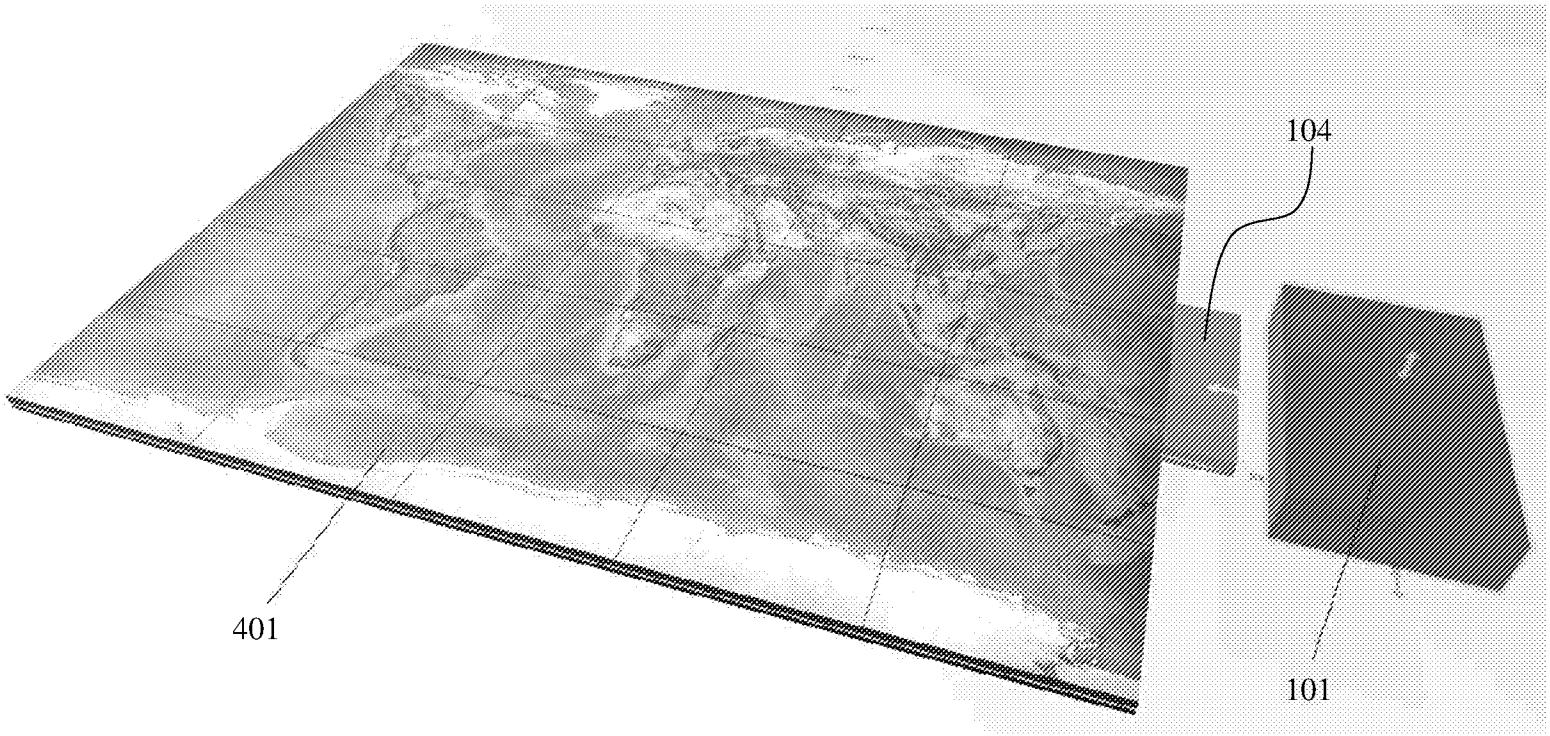
FIG. 6 shows how to connect an interactive platform to a central console of a gaming hardware device according to an aspect of the present disclosure, in which the gaming board is printed with a map of the Earth.

According to one aspect, the game board 401 has a printed external face and is of the same material as said flat bottom support 402, preferably of the same flexible material as the flat bottom support 402 and with such a thickness that the game board can be rolled up with bare hands. In the example shown in FIGS. 6 and 7, a map of the Earth is printed on the outer face of the game board 401. Identifiable pawns 105. i.e. internally equipped with an RFID TAG, and/or elements of other types 106 without RFID TAGs (shown in FIG. 1) and therefore not identifiable, may be positioned on the game board while playing.

The interactive platform 102 comprises the interface 104 functionally connected to the game board, configured to be able to connect the game board to the central console 101 in a detachable manner, so that the central console 101 may be reused to play with interactive platforms 102 of the same type but relative to different games. According to one aspect, the interface comprises: a first electrical connector 301 connected to the array of electrical terminals of the game board; a memory 305, which can be for example a ROM memory, or a flash memory or still of another type, containing information that identifies a game that can be played on the game board, which identifies a related software 107 downloadable on an external microprocessor device, and which identify each of the sensors 103 connected to the respective electrical terminals of the array of electrical terminals of the game board; as well as a second electrical connector 302 having a standard number of electrical input/output terminals functionally connected to the memory 305 and to the first electrical connector 301. The second electrical connector 302 is configured to be electrically connected to the central console 101 and to allow the console control unit 101 to read the information contained in the memory 305 and to send/receive signals to/from the array of electrical terminals of the game board. The memory 305 allows the central console 101 to recognize the game and to understand how to access the individual sensors incorporated in the game board and what they represent on the game board. Thanks to this information, it will be sufficient to connect the interactive platform 102 to the central console 101 and the latter will recognize the game, will know how to read/control each of the sensors 103 and will recognize their nature (antenna, pressure sensor, capacitive touch sensor, etc.).

According to an optional aspect, the first electrical connector 301 of the interface 104 is permanently connected to the array of electrical terminals of the game board. Alternatively, the interface 104 may be disconnected from the game board so as to allow the replacement of the board at a low cost in case of damage.

According to an optional aspect, the interface 104 can be equipped with a processing unit MCU 303 and with a dedicated auxiliary circuitry 306 for the game, to allow the creators of the game to provide further functions specific to the game. The processing unit MCU 303 and the auxiliary circuitry 306 will also be accessible by the central console 101 and interfaced with it when the interactive platform 102 is connected to the central console 101.

In the gaming hardware device of the present disclosure, the central console 101 is configured so as to be reused with interactive platforms 102 of the same type described above, but intended for different games. According to one aspect, it comprises: a third electrical connector 201 having the standard number of electrical input/output terminals so as to be removably connected to the second electrical connector 302 of the interface 104; one or more multiplexers 207 and an RFID reader 205, functionally connected to the third electrical connector 201 for receiving/transmitting signals from/to each individual sensor 103 of the interactive platform 102 when the third electrical connector 201 is connected to the second electrical connector 302; a wireless connection circuit 209 configured to receive/transmit signals from/to the external microprocessor device on which to run the software 107 relating to the game; a microprocessor unit 203 configured to:

- read the memory 305 of the interface 104 when the third electrical connector 201 is connected to the second electrical connector 302,
- controlling the multiplexer(s) 207 and the RFID reader 205 to control the sensors 103 according to the information read from the memory 305 and to receive/transmit signals through the wireless connection circuit 209 from/to the external microprocessor device which performs 107 game software.

In practice, the present antennas 308 are connected via the interface 104 directly to the central console 101. If for example the layer 103 has 25 antennas, there will be 26 tracks (25 antennas+1 GND terminal) leading from the layer 103 to the interface 104, which will simply reconnect these terminals correctly to the central console 101. The addressing of the individual antennas 308 takes place inside the central console 10: by addressing the multiplexer(s) 207, the microprocessor unit 203 of the console control unit 101 connects the single antenna 308 to the RFID reader 205, which will see whether or not there is a pawn 105 above the antenna 308. By cyclically interrogating the antennas 308 present in the game board it is possible to read the status of the board during the evolution of the game. Any other sensors 103 of different types would be connected to the central console 101 in the same way.

According to an optional aspect, the interface 104 comprises an identification circuit 304 containing an anti-counterfeiting code which uniquely identifies the interface 104. The identification circuit 304 will be connected to be read by the microprocessor unit 203 of the central console 101 when the third electrical connector 201 is connected to the second electrical connector 302. If the anti-counterfeiting code is not recognized by the central console 101, it will effectively prevent the execution of any multimedia effect.

According to one aspect, the central console 101 comprises a rechargeable battery 202 configured to power the microprocessor unit 203. Optionally, the central console 101 may be equipped with a touch surface controller 208, and/or with auxiliary components 204 (such as LEDs, a display, etc.) to give information to users regarding the operation of the central console 101, and/or an auxiliary memory 206 made available to the microprocessor unit 203.

A complete game kit according to the present disclosure is illustrated in FIG. 1 and comprises the central console 101, at least one interactive platform 102 and several pawns 105 which can be positioned above the game board 401. Each pawn 105, which can represent a placeholder for a player, or a game character, or any other game piece that can be used in combination with the game board, comprises a respective passive RFID TAG identifying the pawn 105, wherein the passive RFID TAG is configured to be read, when positioned on the game board 401, from an underlying antenna 308 which is present in the layer containing the sensors 103.

To use this kit to play a board game, it is necessary to procure an external microprocessor device, such as a smartphone, tablet, or PC, wirelessly connected to the microprocessor unit 203 of the central console 101. When the third connector 201 of the central console 101 is connected to the second connector 302 of the interface 104 (FIG. 6), the microprocessor unit 203 reads the information contained in the memory 305 of the interface 104 and in this way identifies the game that can be played on the game board, identifies a related game software 107 downloadable on the external microprocessor device (for example, on the smartphone of each of the players) and identifies the sensors 103 connected to the respective electrical terminals of the array of electrical terminals of the game board, understanding which of them is an RFID TAG detection antenna, which is a capacitive touch sensor etc., and to interrogate them and/or recognize the signals coming from each of them. At this point, the game software 107 identified by the information in the memory 305 on the external microprocessor device is downloaded and the game software 107 is run, so that the external microprocessor device interacts with the central console 101 during the evolution of the game.

Figure 7:
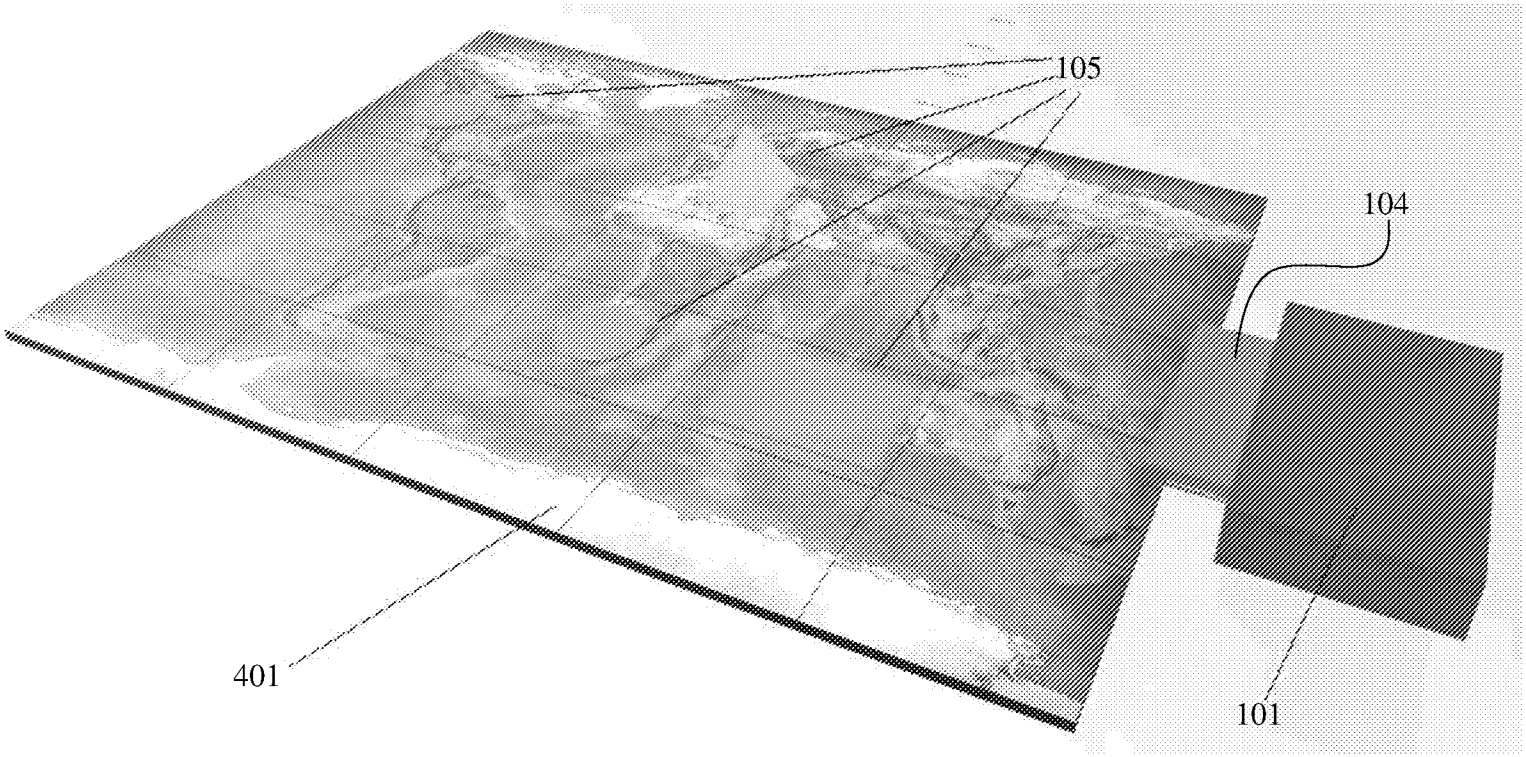
FIG. 7 shows the interactive platform of FIG. 6 connected to the central console of the hardware device in order to detect the presence and position of the pawns on the game board printed with a geographical map of the Earth.

While the players place the pawns 105 or other unidentifiable game pieces 106 (i.e. without RFID TAGs), the central console 101 controls the sensors 103 of the game board via the microprocessor unit 203 and the multiplexer(s) 207, to detect the presence of at least one pawn 105 above the game board 401 (FIG. 7). The microprocessor unit 203 reads through the RFID reader 205 the RFID TAG of at least one pawn 105 placed above the game board 401, identifying the pawn and its position above the game board 401, then transmits to the external microprocessor device, connected to the central console 101 via the wireless communication circuit 209, identification information of the pawn 105 and position information of the antenna 308 above which the pawn 105 has been placed. Taking this information into account, the game software 107 running on the external microprocessor device is updated on the position and type of pieces physically present on the game board 401, and generates corresponding multimedia game effects that change during the evolution of each batch.

Thanks to this organization, it is possible to produce low-cost and game-specific interactive platforms 102, as the most sophisticated and expensive circuitry is in the central console 101, which is reusable for different games. Furthermore, it is easy to prepare the hardware device for the game of this disclosure, as it is sufficient to connect the interface 104 of the interactive platform 102 in the central console 101 that, by reading the ROM memory 305, recognizes the game, identifies the software 107 to be download to competitors' smartphones or tablets (or even PCs), and automatically configures itself to control the sensors 103. In practice, the game board with the interface 104 acts as a cartridge for a multi-purpose game central console 101.

The present invention has been described so far with reference to preferred embodiments. It is understood that there may be other embodiments which refer to the same inventive core defined by the scope of the following claims.

The invention claimed is:

1. A gaming hardware device, comprising a central console and at least one interactive platform removably connectable to said central console, wherein said at least one interactive platform comprises:

a game board apparatus, comprising:

a flat bottom support, a layer containing a plurality of sensors, said layer being arranged above said flat bottom support, each sensor of said plurality of sensors being individually accessible through a respective electrical line which leads to a respective electrical terminal of an array of electrical terminals of the game board apparatus, a game board arranged above the layer containing said plurality of sensors and configured so as to cover and to sandwich the plurality of sensors together with said flat bottom support, leaving uncovered said array of electrical terminals of the game board apparatus, wherein said plurality of sensors comprises at least one antenna-configured to read a RFID TAG placed on the game board above said antenna generating a corresponding response signal made available on a respective electrical terminal of said array of electrical terminals of the game board apparatus;

an interface functionally connected to the game board apparatus, said interface comprising:

a first electrical connector connected to the array of electrical terminals of the game board apparatus, a memory containing information which: identifies a game that can be played on the game board apparatus, identifies a related software downloadable on an external microprocessor device, and identifies said plurality of sensors connected to the respective electrical terminals said array of electrical terminals of the game board apparatus;

a second electrical connector having a standard number of electrical input/output terminals functionally connected to said memory and to said first electrical connector, said second electrical connector being configured to be electrically connected to a central console and to allow said central console to read the information contained in said memory, to send/receive signals to/from said array of electrical terminals of the game board apparatus;

wherein said central console comprises:

a third electrical connector having said standard number of electrical input/output terminals, wherein said third electrical connector is configured to be removably connected to said second electrical connector of the interface, at least one multiplexer and a RFID reader, functionally connected to said third electrical connector to receive/transmit signals from/to each single sensor of said plurality of sensors when said third electrical connector is connected to said second electrical connector, a wireless connection circuit, configured to receive/transmit signals from/to said external microprocessor device, a microprocessor unit configured to read the memory of said interface when said third electrical connector is connected to said second electrical connector, to control said at least one multiplexer and said RFID reader to control said plurality of sensors as a function of the information read from said memory and to receive/transmit signals from/to said external microprocessor device through the wireless connection circuit.

2. The device according to claim 1, wherein said plurality of sensors comprises a plurality of antennas disposed above said flat bottom support, each antenna of said plurality of antennas being configured to be individually activated by means of a respective electrical terminal of said array of electrical terminals of the game board apparatus and to read an RFID TAG placed on the game board above said antenna generating a corresponding response signal made available on the respective electrical terminal of the array of electrical terminals of the game board apparatus.

3. The device according to claim 1, wherein the layer containing said plurality of sensors is made by means of a flexible Printed Circuit Board and said flat bottom support is made entirely of flexible material and with a thickness determined so as to being able to be rolled up with bare hands together with the layer containing said plurality of sensors and with said game board.

4. The device according to claim 1, wherein said central console comprises a rechargeable battery configured to power said microprocessor unit.

5. The device according to claim 1, wherein said interface comprises an identification circuit containing a code that uniquely identifies the interface, said identification circuit being connected so as to be read by the microprocessor unit of the central console when said third electrical connector is connected to said second electrical connector.

6. The device according to claim 1, wherein said first electrical connector of the interface is permanently connected to the array of electrical terminals of the game board apparatus.

7. The device according to claim 1, in which said game board is flat, has a printed outer face and is of the same material as said flat bottom support.

8. A board game kit, comprising:

a gaming hardware device according to claim 1;

a plurality of pawns that can be positioned above said game board, wherein each pawn of said plurality of pawns comprises a respective passive RFID TAG identifying said pawn, said passive RFID TAG being configured to be read, when positioned on the game board, by an antenna of said plurality of sensors surmounted by said RFID TAG.

9. A control method of a board game kit according to claim 8, comprising the following operations:

providing an external microprocessor device wirelessly connected to the microprocessor unit of the central console;

connecting said third connector of the central console to said second connector of the interface;

reading, with said microprocessor unit of the central console, information contained in the memory of said interface to identify a game that can be played on the game board apparatus, to identify a related game software downloadable on the external microprocessor device and to identify the plurality of sensors connected to the respective electrical terminals of the array of electrical terminals of the game board apparatus;

downloading said game software on the external microprocessor device and running said game software on the external device;

reading said plurality of sensors of the game board apparatus by means of said microprocessor unit and said at least one multiplexer of the central console, to detect the presence of at least one pawn of said pawns above the game board apparatus;

reading, with said microprocessor unit and said RFID reader, an RFID TAG of at least one pawn of said pawns placed above the game board, identifying said at least one pawn;

transmitting to said external microprocessor device, through said microprocessor unit and said wireless communication circuit, information identifying said at least one pawn and the position of said at least one antenna above which said pawn is placed;

executing said game software with said identification and position information, generating corresponding multimedia game effects with said external microprocessor device.

* * * * *